United States Patent [19]

Brown

[11] Patent Number: 4,632,350

[45] Date of Patent: Dec. 30, 1986

[54] ROTATABLE AND VERTICALLY ADJUSTABLE DISPENSER SUSPENSION MEANS

[75] Inventor: Bruce Brown, Cincinnati, Ohio

[73] Assignee: The Procter & Gamble Company, Cincinnati, Ohio

[21] Appl. No.: 663,290

[22] Filed: Oct. 22, 1984

[51] Int. Cl.[4] ..... A47K 1/08

[52] U.S. Cl. ..... 248/295.1; 248/307; 248/311.2

[58] Field of Search ..... 248/295.1, 214, 307, 248/311.2, 414; 4/227, 228

[56] References Cited

U.S. PATENT DOCUMENTS

| | | | |
|---|---|---|---|
| 214,618 | 4/1879 | Bruen . | |
| 249,500 | 11/1881 | Bruen . | |
| D. 265,501 | 7/1982 | Cotes | 4/228 X |
| 276,130 | 4/1883 | Bruen . | |
| 3,241,718 | 3/1966 | Kemper | 222/57 |
| 3,547,392 | 12/1970 | Tanzer | 248/340 X |
| 3,604,020 | 9/1971 | Moisa | 4/228 |
| 3,627,177 | 12/1971 | Marcus et al. | 222/181 |
| 3,768,684 | 10/1973 | Buchtel | 215/100 R |
| 3,883,024 | 5/1975 | Thomas | 215/100 |
| 3,891,176 | 6/1975 | Downing et al. | 248/340 |
| 3,943,582 | 3/1976 | Daeninckx et al. | 4/227 |
| 3,998,360 | 12/1976 | Mack | 222/181 |
| 4,101,043 | 7/1978 | Johnson, Jr. et al. | 215/100 R |
| 4,436,269 | 3/1984 | Dirksing et al. | 248/214 |
| 4,451,941 | 6/1984 | Gray | 4/228 |
| 4,453,278 | 6/1984 | Doggett et al. | 4/227 X |
| 4,455,692 | 6/1984 | Hegge et al. | 4/228 |

FOREIGN PATENT DOCUMENTS

| | | | |
|---|---|---|---|
| 1256631 | 2/1961 | France | 4/228 |

*Primary Examiner*—Ramon S. Britts
*Assistant Examiner*—Karen J. Chotkowski
*Attorney, Agent, or Firm*—Richard C. Witte; John V. Gorman; Ronald J. Snyder

[57] ABSTRACT

A vertically adjustable hanger for supporting a dispenser for adding a chemical to a toilet tank on a vertical wall member of such toilet tank at a predetermined height to be selected by the user is described as including a bayonet member having means on its upper end for attachment to such toilet tank wall, and a channel means located on the chemical dispenser. The bayonet member further includes vertical adjustment means and, in a preferred embodiment, vertical control means located below its attachment means. The attachment means is rotatable between a predetermined substantially non-obstructive storage position and a hanging position, and when rotated from storage position to hanging position, increases the effective thickness of the dispenser. The channel means has a predetermined length, width and thickness and, in a preferred embodiment, includes locking means which cooperate with the vertical control means of the bayonet member to prevent vertical adjustment of the bayonet member except when the attachment means is in hanging position. The vertical adjustment means interacts with the channel means to provide vertical adjustability of the bayonet within the channel, whereby the vertical position of the dispenser may be adjusted as desired by rotating the attachment means into hanging position, and thereafter, advancing or retracting the bayonet member within the bayonet member within the channel means in a direction generally parallel to its length.

15 Claims, 4 Drawing Figures

ROTATABLE AND VERTICALLY ADJUSTABLE DISPENSER SUSPENSION MEANS

TECHNICAL FIELD

This invention relates to a rotatable and vertically adjustable suspension means for dispensers, and, more particularly, to a vertically adjustable hanger for supporting a toilet tank dispenser on a vertical wall member of the toilet tank wherein such hanger is rotatable from a predetermined shipping or storage position to its proper hanging position.

BACKGROUND ART

Suspension systems for dispensers to be placed within water closets or toilet tanks are relatively abundant in the art. For example, the commonly owned U.S. Pat. No., 4,436,269, which issued to Robert S. Dirksing and Dale E. Barker on Mar. 13, 1984, discloses a vertically adjustable dispenser suspension means for locating a dispenser on a vertical wall member of a toilet tank. The Dirksing et al. suspension means comprises a bayonet member and a channel means into which the bayonet member inserts. At least one resiliently deformable projection located along a longitudinal edge of either the bayonet member or the channel means interacts with a multiplicity of spaced projection receiving means located along the longitudinal edge of the other of either the bayonet member or the channel means to provide spring-loaded detenting vertical adjustability thereof.

Another vertically adjustable dispenser suspension means is shown in U.S. Pat. No. 3,768,684, which issued to Dean H. Buchtel on Oct. 30, 1973. The Buchtel hanging device comprises a ribbed strap which is received within a groove formed in a dispenser bottle wherein the dimensions of the rib on the strap provide an interference fit between the strap and the bottle groove. The frictional interaction between such strap and the groove is sufficient to prevent relative movement between the two except when purposely manually adjusted. At the top of the hanger strap is a hook means for attachment of the suspension system to the wall of a toilet tank. A notch is formed in the bottle such that when the hanger strap is moved to its fully retracted position, the hook nests within the notch for convenient packaging and shipment U.S. Pat. No. 4,451,941, which issued to James R. Gray on June 5, 1984, discloses a toilet bowl sanitizer dispenser which includes a hook member provided to hang over the top rim of the toilet tank and thereby fasten the dispenser to the sidewall thereof. The dispenser is formed with a pair of vertically aligned holes through which the hook member is passed. A rib serves to press the hook member against the top and bottom ends of a recess, thereby holding the dispenser in place. The Gray hook member, however, cannot be moved to a non-obstructive storage position except when totally removed from the dispenser.

Other prior art hanger systems have been designed to be rotatable from a shipping and/or storage position to an open position for use. U.S. Pat. No. 3,883,024, which issued to Douglas W. Thomas on May 13, 1975, discloses a hanger device for suspending a container in an inverted position on the wall of a water closet. In particular, the Thomas hanger comprises an L-shaped metal strip which is rotatably connected to the end wall of the container, and is designed to conform to the shape of the portion of the container to which it abuts in storage position in order to minimize space requirements during shipping and storage. In use, the Thomas hanging clip is rotated to an open position wherein it extends past the end wall of the container to engage the tank wall of a water closet in order to suspend the dispenser in an inverted position. Similarly, U.S. Pat. No. 3,998,360, which issued to Frank J. Mack on Dec. 21, 1976, concerns a hanger device for suspensing a dispensing container from the wall of a water closet. The Mack hanger comprises a horizontal planar member connected to the upper end of the cylindrical shaft which is retained in recesses formed in the side wall of the container. The shaft and planar member are designed to swivel such that the planar member may be moved from a storage position, wherein it is substantially flush with the container, to a position where it will engage the top of the wall of the water closet. Mack also contemplates that the shaft of such hanger may be designed to freely vertically reciprocate a predetermined distance R within the recesses formed in the container.

Despite all of the prior work done in this area, as is apparent from the above discussion, there remains problems of providing a vertically adjustable hanger system which does not add unnecessary size and packaging expense and/or inconvenience to the dispenser product. None of the prior art hanging systems provide a suspension means which can be vertically adjusted, which does not add unnecessary dimensions to a dispenser during shipping and/or storage, and which, in use, is conveniently rotatable to a position extending beyond the dispenser for suspension of such dispenser on a toilet tank wall.

DISCLOSURE OF THE INVENTION

It is an object of this invention to obviate the abovedescribed problems.

It is another object of the present invention to provide a vertically adjustable hanger for supporting a dispenser for adding a chemical to a toilet tank or a vertical wall member thereof, with such hanger being rotatable to a non-obstructive position during shipping and storage and to a proper hanging position during use.

It is yet another object of the present invention to provide a hanger for supporting a dispenser on a vertical wall of a toilet tank wherein such dispenser may be vertically adjusted to a predetermined height selected by the user when such hanger is oriented into proper hanging position.

It is a further object of the present invention to provide a vertically adjustable rotatable hanger for supporting a dispenser on a vertical wall of a toilet tank, wherein such hanger can be vertically adjusted only when oriented into its proper hanging position, thereby preventing misuse of such hanger and dispenser.

In accordance with one aspect of the present invention, there is provided a vertically adjustable hanger for supporting a dispenser for adding a chemical to a toilet tank on a vertical wall member of the toilet tank at a predetermined height to be selected by the user, such dispenser having a predetermined thickness. The adjustable hanger includes a bayonet member having means on its upper end for attachment to the toilet tank wall and vertical adjustment means, and a channel means on the chemical dispenser having a predetermined length, width and thickness. The attachment means of the bayonet member is rotatable between a predetermined non-obstructive storage position and a hanging position, and increases the effective thickness of the dispenser when rotated from the storage position to the hanging position. In a preferred embodiment, the channel means includes locking means which cooperates with vertical control means formed on the bayonet member below its attachment means to prevent vertical adjustment of the bayonet member within the channel means except when the attachment means is oriented into proper hanging position. Once the attachment means is rotated into proper hanging position, the vertical position of the dispenser may be adjusted as desired by advancing or retracting the bayonet member within the channel means in the direction generally parallel to its length.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
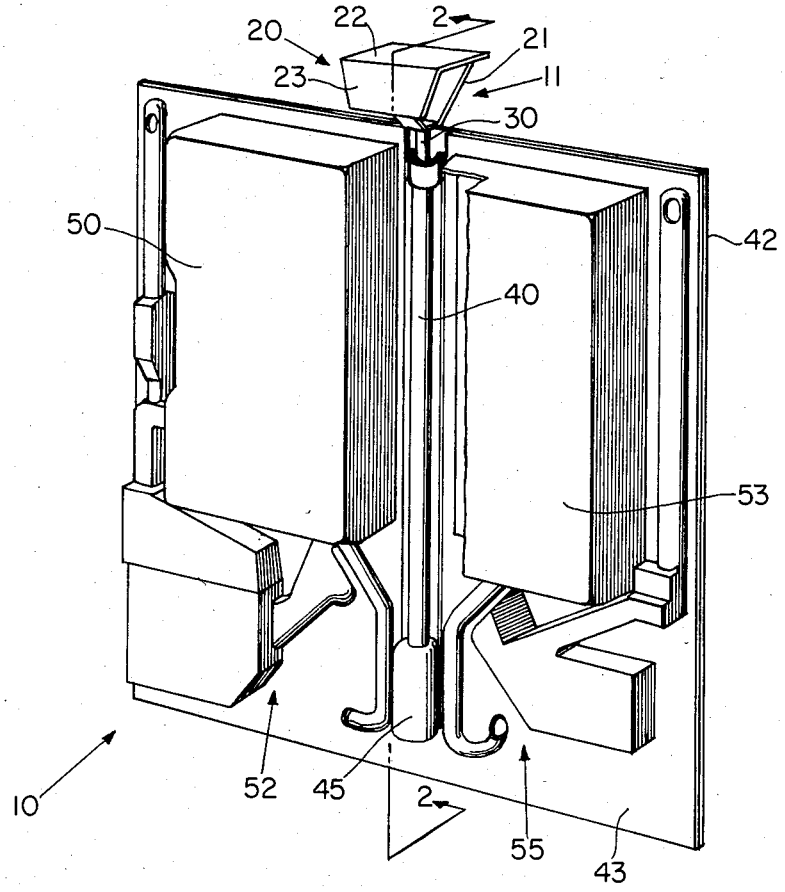
FIG. 1 is a perspective view of a toilet tank dispenser including a preferred embodiment of the rotatable and vertically adjustable suspension means of the present invention, and having a portion of the dispenser broken away to provide a better view of the suspension means.

Referring now to the drawings in detail, wherein like numerals indicate the same elements throughout the views, FIG. 1 illustrate a perspective view of a toilet tank dispenser 10 incorporating a preferred vertically adjustable suspension means of the present invention. A portion of dispenser 10 has been broken out to provide a better view of the adjustable suspension means thereof. This illustrated hanger embodiment will be described in connection with the present invention for simplicity only, and it should be understood that the present invention is not limited to this embodiment. The illustrated hanger embodiment comprises bayonet member 11 which is received within channel means 40 on the dispenser 10. Bayonet member 11 is illustrated as a substantially cylindrical rod 30 having hook means 20 formed on its upper end for attachment on a vertical wall member of a toilet tank. Any means of attachment of the bayonet member may be utilized, however, it is preferred that such attachment means comprise a hook for convenience and simplicity.

Hook 20 is further illustrated as comprising a vertical back portion 21 connected at its uppermost end to an intermediate horizontal portion 22, which in turn is connected at its forward edge to a downwardly disposed hanger leg 23. The bayonet member 11 is thereby adapted to hook over a vertical wall member (not shown) of a toilet tank such that intermediate horizontal portion 22 will be resting on the top horizontal edge of the wall member and hanger leg 23 will be acting as the means to retain the bayonet member thereon. The dimensions of hook 20 can be varied as required to accommodate various thicknesses of toilet tank wall members. The hook 20 may also include an inwardly angulated flexible tab 24 (see FIG. 2) to facilitate the support of the dispenser 10 from a toilet tank wall in as near a vertical position as possible. Such a tilt-compensating feature is generally disclosed in the commonly assigned U.S. Pat. No. 4,247,070, issued to Robert S. Dirksing on Jan. 27, 1981, said patent being hereby incorporated herein by reference.

Figure 2:
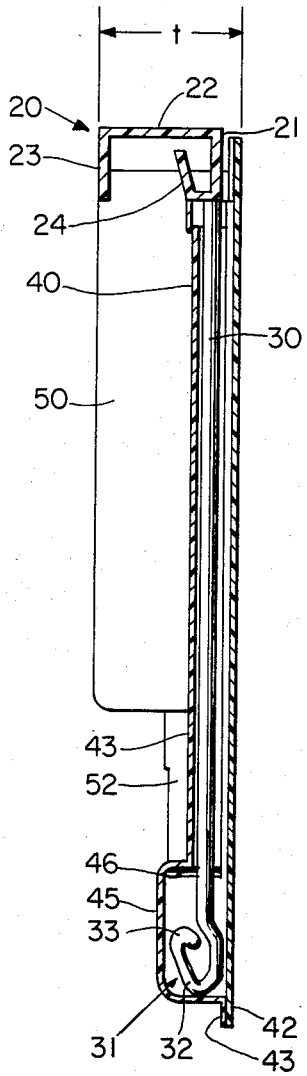
FIG. 2 is a vertical cross-sectional view of the dispenser of FIG. 1, taken along the line 2—2 of FIG. 1, illustrating the rotatable and vertically adjustable suspension means as it would appear in its non-obstructive storage position.

As shown in FIG. 2, dispenser 10 is preferably formed with a predetermined thickness t. Thickness t will generally be determined in accordance with functional requirements of the dispenser system, such as chemical storage requirements, solution volume requirements, etc. For economy of packaging and storage space required, it is preferred tht the dimensions of hook 20 not exceed the predetermined thickness t when hook 20 is in storage position, as illustrated in FIG. 2. These thickness dimensions will be further discussed below.

Cylindrical rod 30 is shown as being integrally attached to a bulb member 31 at its lower end comprising a hook-like shaped coil member 32 having a vertical control means or upper locking element 33. Upper locking element 33 is designed to interact with corresponding locking means 46 on the upper inner surfaces of enlarged portion 45 of channel means 40 on the dispenser. Upper locking element 33 and locking means 46 are shown only as a preferred example of vertical control means of bayonet member 11 and locking means of channel means 40, which cooperatively interact to prevent vertical adjustment of bayonet member 11 within channel 40 when hook 20 is in storage position. Further, bulb member 31 is shown only as an example of vertical adjustment means by which bayonet member 11 can be made vertically adjustable within channel 40. Other means of providing vertical adjustability of bayonet member 11 within channel 40 can equally be utilized. For example, cylindrical rod 30 could simply be dimensioned such that at least a portion of its length would create an interference or frictional interaction with the inner surfaces of channel 40 thereby providing vertical adjustability of bayonet member 11. Alternative means of providing vertical adjustability of bayonet member 11 are described in commonly assigned U.S. Pat. No. 4,436,269, issued to Robert S. Dirksing and Dale E. Barker on Mar. 13, 1984, said patent being hereby incorporated herein by reference.

Figure 3:
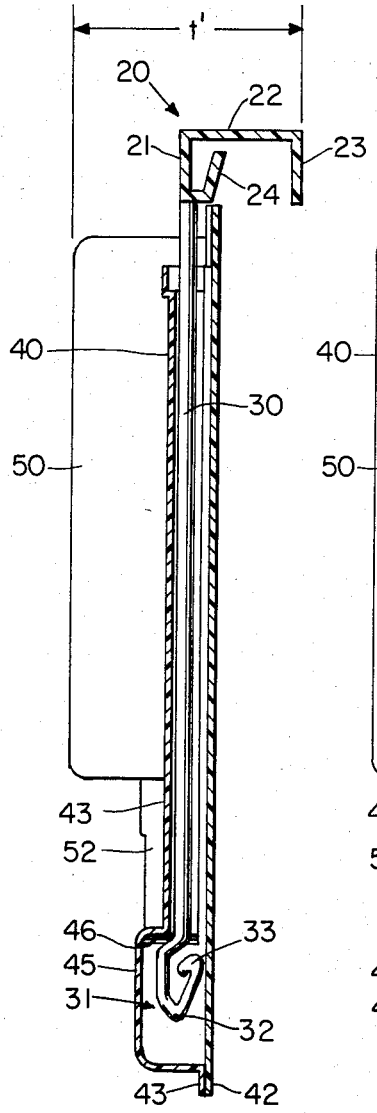
FIG. 3 is a vertical cross-sectional view of the dispenser of FIG. 1 illustrating the rotatable and vertically adjustable suspension means after it has been rotated into its hanging position.
Figure 4:
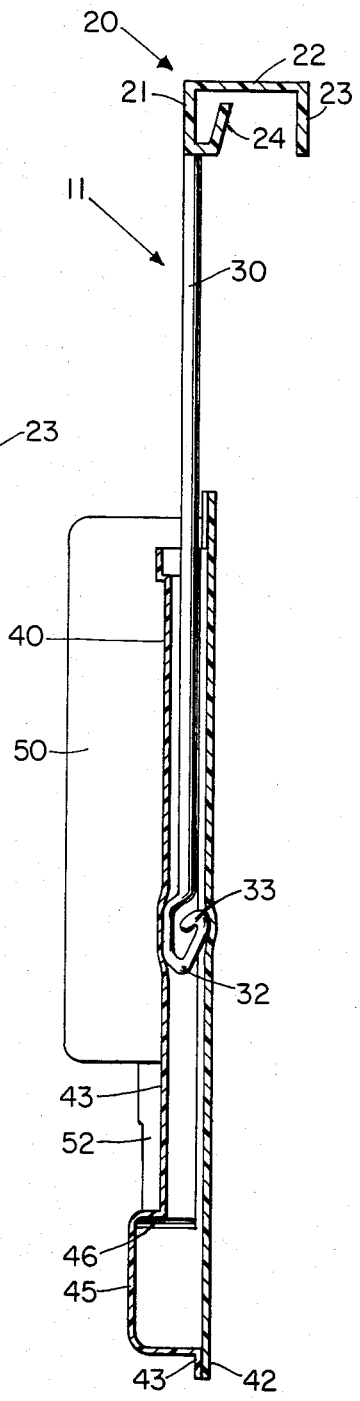
FIG. 4 is a vertical cross-sectional view of the dispenser of FIG. 1 illustrating the rotatable and vertically adjustable suspension means which has been vertically adjusted upwardly.

Bulb member 31 is designed to be compressible within channel 40 when hook 20 is oriented into proper hanging position, as illustrated in FIGS. 3 and 4. In particular, FIG. 3 illustrates bayonet member 11 after it has been rotated from its storage position (FIG. 2) approximately 180° to its proper hanging position. As can be seen, rotation of hook 20 substantially increases the effective thickness of dispenser 10, as illustrated by thickness t' of FIG. 3. Rotation to proper hanging position also moves the outwardly extending member or upper locking element 33 out of interactive contact with the locking means 46 of channel 40. Once rotated to proper hanging position, bayonet member 11 may be vertically adjusted within channel 40, as illustrated in FIG. 4. It is contemplated that bayonet member 11 need not include structure designed to prevent vertical adjustment thereof when in storage position, however, it is preferred that such structure (e.g. locking element 33 and locking means 46) be so included to prevent misuse of the hanger system.

For purposes of illustration, the suspension means described herein can be used to support a toilet tank dispenser of the type generally disclosed in the commonly assigned U.S. Pat. No. 4,171,546, issued to Robert S. Dirksing on Oct. 23, 1979, said patent being hereby incorporated herein by reference. Dispenser 10 of the present invention is shown as including product reservoirs 50 and 53, respectively, and appropriate plumbing structures 52 and 55, respectively, to provide dispensing of chemical products in response to water level changes within the toilet tank. Dispenser 10 is shown only as an illustrative embodiment, as the dispenser suspension means of the present invention can be utilized to support any dispenser for adding a chemical to a toilet tank on a vertical wall member of such toilet tank.

As illustrated in the figures, the channel 40 is formed with a shape which substantially conforms to that of bulb member 31, and has an enlarged portion 45 at its lower end having a locking means 46 formed as a ledge or undercut portion on its upper inner surfaces. Enlarged portion 45 is dimensioned to enable substantially unemcumbered rotation of bulb member 31 therewithin, and to allow bayonet member 11 and its hook 20 to be vertically raised a small distance prior to such rotation to permit such rotation without interference between the back wall 42 and the lower portions of flexible tab 24. Enlarged portion 45 also allows bulb member 31 to remain in an uncompressed state while in storage position, thereby preventing permanent deformation or "cold flow" thereof while in storage position. It has been observed that compressible structures (especially those made of plastic material) may tend to assume a permanently deformed conformation if held in compressed condition for long periods of time. Therefore, it is preferred to avoid such prolonged compression of bulb member 31 prior to use in order to optimize the frictional interaction between bulb member 31 and channel 40 during adjustment procedures and use.

As described above, locking means 46 is designed to interact with upper locking element 33 of bayonet member 11 when hook 20 is in storage position to prevent vertical adjustment of bayonet member 11 within channel 40. It is contemplated that such vertical adjustment control could be accomplished by other means known or conceivable to one skilled in the art. For example, the outwardly extending member/upper locking element 33 could be formed near the upper end of cylindrical rod 30, and the locking means of channel 40 could correspondingly be located near the upper end of dispenser 10. The locking means within channel 40 could alternatively comprise merely a small opening formed through the back wall 42 of dispenser 10 through which an outwardly extending member of bayonet member 11 would project and lockingly engage when hook 20 was in storage position. It should, therefore, be understood that any adjustment control means could be incorporated on bayonet member 11 for interaction with locking means on dispenser 10, and that the specific structure described is simply a preferred execution of such.

It should also be understood that while it is preferred that the vertical control means (e.g. locking element 33) of bayonet member 11 be combined with a friction-type element such as bulb member 31 to integrally provide vertical adjustability of the suspension means while preventing such vertical adjustment when in a storage position, the two functions need not be combined. In some particular applications, such as were it is desired to locate the adjustment control means nearer the upper end of bayonet member 11, it might be necessary to make these structures independent of one another.

Channel means 40 may be integrally formed in the front wall 43 of dispenser 10, such as by thermoforming a sheet of thermoplastic material to establish the desired product storage areas (e.g. product reservoirs 50 and 53), dispensing plumbing (e.g. plumbing structures 52 and 55), and channel means (e.g. channel means 40). Alternatively, channel means 40 could be attached to dispenser 10 as an independent structure. For economy and simplicity, it is preferred that channel means 40 be formed integrally in the front wall 43 of dispenser 10, and that back wall 42 of dispenser 10 also serve as the back surface of channel means 40. Channel means 40 is illustrated in FIG. 1 as featuring a shape which substantially conforms to the hook-shaped coil 32 when bayonet member 11 is rotated into proper hanging position. By substantially conforming to such coil 32, the non-symmetrical cross section of channel means 40 can further serve to prevent rotation of hook means 20 during adjustment procedures, thereby insuring that bayonet member 11 will remain in proper hanging position. It should be understood that rotation of hook means 20 during vertical adjustment procedures can equally be prevented by other means known or conceivable by one skilled in the art; for example, a symmetrical channel having one or more guide ribs or the like might be designed to interact with corresponding structure on the bulb member 31. It is also contemplated that prevention of rotation of hook means 20 during vertical adjustment procedures may not be a substantial concern in many applications, and, therefore, need not be considered in the design thereof.

In use, toilet dispenser 10 is packaged and shipped with its hanger attachment means or hook 20 in non-obstructive storage position, as shown in FIG. 2. In particular, hook 20 is rotated inwardly such that it does not extend substantially beyond the thickness t of dispenser 10, and bayonet member 11 is fully retracted within channel means 40. With its attachment means in such non-obstructive storage position, the dispenser and its suspension means occupy minimum space, thereby minimizing packaging and storage costs. Prior to use, a consumer simply lifts hook 20 slightly (to avoid interference between back wall 42 and hook 20) and rotates it approximately 180° into proper hanging position, as illustrated in FIG. 3. Once rotated into proper hanging position, bulb member 31 is compressible within channel 40 and bayonet member 11 may be vertically adjusted as desired by advancing or retracting it within channel 40 in a direction generally parallel to its length. The consumer, therefore, simply attaches hook 20 over the upper edge of a toilet tank wall and thereafter pushes downwardly on the dispenser until the dispenser is supported at the proper vertical position within the toilet tank.

It is contemplated that channel 40 can be formed with stop means (not shown) to limit the vertical movement of bayonet member 11 so that it cannot be completely withdrawn therefrom. Such means could be formed as an inwardly projecting undercut portion within the upper confines of channel 40 which would engage a portion of bulb member 31 to prevent its further upward movement, however, any similar structure known or conceivable by one skilled in the art could be equally utilized.

To practice the present invention, bayonet member 11 must be formed of a material which is structurally capable of rigidly supporting a dispenser and which features sufficient resilience so that bulb member 31 may be compressed within channel 40 to thereby frictionally engage the inner surfaces thereof to provide vertical adjustability to the dispenser suspension system. Bayonet member 11 need not be foremd of a single material, and, as described above, can be designed to frictionally interact with a channel member or to interact therewith in any manner by which vertical adjustability of the hanger can be achieved. In this regard, bayonet member 11 may be made of several pieces connected together in an appropriate manner. For example, hook 20 might be rotatably connected to the upper end of cylindrical rod 30, so that only the cylindrical rod 30 and bulb member 31 need be formed of a resilient/compressible material. Therefore, the particular materials selected for dispenser 10, channel 40, and/or bayonet member 11 might vary according to particular circumstances involved. It is preferred that resilient thermoplastic material (e.g. relatively thin flexible plastic such as high-impact styrene or polyvinyl chloride, both of which are commonly available in the industry) be used for channel 40 so that it will provide and tolerate sufficient deformation to permit vertical adjustability of bayonet member 11 therewithin without catastrophic failure. Bayonet member 11 may be made from thermoplastic material also, and is to be slightly thicker and more rigid to provide support for dispenser 10. A preferred material for bayonet member 11 is polypropylene (also commonly available in the industry). Although not critical, it is preferred that bayonet member 11 be formed as a single piece for simplicity and economy.

As mentioned above, a rotatable and vertically adjustable dispenser suspension means could be made in accordance with the subject invention without incorporation of vertical control means (e.g. locking element 33) and locking means (e.g. locking means 46) to prevent vertical adjustment of bayonet member 11 while the attachment means (e.g. hook 20) is in storage position. While such structure is preferred to prevent misuse, the subject hanger can equally provide vertical adjustability among three or more vertical adjustment heights and feature rotatability between a substantially non-obstructive storage position and a proper hanging position without such vertical control structure, especially in applications where avoidance of misuse is not of substantial concern. An example (not shown) of such a dispenser suspension means would be a vertically adjustable hanger of the general type discussed herein comprising a bayonet member featuring attachment means (such as hook 20) and vertical adjustment means (such as frictional interaction of such bayonet member within a channel means), and a channel means of predetermined length, width and thickness to receive such bayonet member so as to allow rotation of the bayonet member therewithin while interacting with the bayonet member to provide vertical adjustability thereof among a plurality of vertical adjustment heights. Such rotatability and adjustability could be achieved in a variety of specific ways, such as by simple frictional interaction, detenting interaction, or the like.

Having shown and described the preferred embodiment of the present invention, further adaptions of the suspension means can be accomplished by appropriate modifications by one of ordinary still in the art without departing from the scope of the present invention. Some of such modifications have been described above. Accordingly, the scope of the present invention should be considered in terms of the following claims and is understood not to be limited to the details of structure and operation shown and described in the specification and drawings.

I claim:

1. A vertically adjustable hanger for supporting a dispenser for adding a chemical to a toilet tank on a vertical wall member of said toilet tank at a predetermined height selected by the user, said dispenser having a predetermined thickness, and said hanger comprising:

(a) a bayonet member having attachment means on its upper end for attachment to said wall member and vertical adjustment means, said attachment means being rotatable between a predetermined non-obstructive storage position and a hanging position, and said attachment means effectively increasing the predetermined thickness of said dispenser when rotated from said storage position to said hanging position;

(b) a channel means on said dispenser, said channel means having a predetermined length, width and thickness, said vertical adjustment means of said bayonet member interacting with said channel means to provide vertical adjustability of said bayonet member within said channel means and to secure said bayonet member at a desired adjustment height, whereby the vertical position of said dispenser may be adjusted among a plurality of vertical adjustment heights as desired by advancing or retracting said bayonet member within said channel means in a direction generally parallel to its length; and (c) vertical control means on said bayonet member to prevent substantial vertical movement of said bayonet member within said channel means except when said attachment means is in hanging position and to limit vertical movement of said bayonet member to a predetermined distance necessary to permit rotation of said attachment means from storage position to hanging position without interference between said attachment means and other dispenser structure.

2. The vertically adjustable hanger of claim 1, wherein said vertical adjustment means comprises frictional interaction of said bayonet member within said channel means, thereby providing vertical adjustability of said hanger.

3. A vertically adjustable hanger for supporting a dispenser for adding a chemical to a toilet tank on a vertical wall member of said toilet tank at a predetermined height selected by the user, said dispenser having a predetermined thickness, and said hanger comprising:

(a) a bayonet member having means on its upper end for attachment to said wall member, vertical adjustment means, and vertical control means below said attachment means, said attachment means being rotatable between a predetermined non-obstructive storage position and a hanging position, and said vertical control means substantially preventing vertical adjustment of said bayonet member except when said attachment means is oriented into said hanging position; said attachment means increasing the effective thickness of said dispenser when rotated from said storage position to said hanging position;

(b) a channel means on said dispenser, said channel means having a predetermined length, width and thickness and including locking means which cooperate with said vertical control means of said bayonet member to prevent vertical adjustment of said bayonet member within said channel except when said attachment means is in hanging position, and said vertical adjustment means interacting with said channel means to provide vertical adjustability of said bayonet member within said channel means and to secure said bayonet member at a desired adjustment height, whereby the vertical position of said dispenser may be adjusted as desired by rotating said attachment means into hanging position and thereafter advancing or retracting said bayonet member within said channel means in a direction generally parallel to its length and (c) said vertical control means limiting vertical movement of said bayonet member to a predetermined distance necessary to permit rotation of said attachment means from storage position to hanging position without interference between said attachment means and other dispenser structure when said attachment means is not in hanging position.

4. The vertically adjustable hanger of claim 3, wherein said vertical control means of said bayonet member comprises an outwardly extending member which engages with said locking means of said channel means to prevent vertical adjustment of said bayonet member within said channel means when said attachment means is oriented into storage position, and wherein said outwardly extending member is disengaged from said locking attachment means to thereby permit vertical adjustment of said bayonet member within said channel when said attachment means is rotated into said hanging position.

5. The vertically adjustable hanger of claim 4, wherein said vertical adjustment means comprises frictional interaction of said bayonet member within said channel means, thereby providing vertical adjustability of said hanger.

6. The vertically adjustable hanger of claim 5, wherein said vertical adjustment means comprises a substantially resilient bulb member which frictionally engages the inner surfaces of said channel means to provide said vertical adjustability of said bayonet member within said channel.

7. The vertically adjustable hanger of claim 6, wherein said resilient bulb member is formed on the lower end of said bayonet member.

8. The vertically adjustable hanger of claim 7, wherein said outwardly extending member of said bayonet member is formed integrally with said resilient bulb member, and wherein said channel means comprises an enlarged portion formed in the lower end of said channel means, with said enlarged portion including said locking means which cooperates with said outwardly extending member to prevent vertical adjustment of said bayonet member when said attachment means is oriented into storage position.

9. The vertically adjustable hanger of claim 8, wherein said resilient bulb member is a substantially hook-shaped resilient coil which is laterally compressible within said channel means when said attachment means is oriented into hanging position, and wherein said outwardly extending member comprises an upper locking element formed on said hook-shaped coil which interacts with the upper surface of said enlarged portion of said channel means thereby resisting such lateral compression and preventing vertical adjustment of said bayonet member when said attachment means is oriented into storage position.

10. The vertically adjustable hanger of claim 9, wherein said attachment means comprises a hook for securing said hanger to said vertical wall member.

11. A vertically adjustable hanger for supporting a dispenser for adding a chemical to a toilet tank on a vertical wall member of said toilet tank at a predetermined height selected by the user, said dispenser having a predetermined thickness, and said hanger comprising:

(a) a bayonet member having hook means on its upper end for attachment to said wall member, vertical adjustment means, and vertical control means below said hook means, said bayonet member being rotatable between a predetermined non-obstructive storage position and a hanging position, and said vertical control means substantially preventing vertical adjustment of said bayonet member except when said bayonet member is oriented into said hanging position; said hook means increasing the effective thickness of said dispenser when rotated from said storage position to said hanging position;

(b) a channel means on said dispenser, said channel means having a predetermined length, width and thickness and including locking means which cooperate with said vertical control means of said bayonet member to prevent vertical adjustment of said bayonet member within said channel except when said hook means is in hanging position and to secure said bayonet member at a desired adjustment height, said vertical adjustment means of said bayonet member frictionally interacting with the inner surfaces of said channel means, whereby the vertical position of said dispenser may be adjusted as desired by rotating said bayonet member into hanging position and thereafter advancing or retracting said bayonet member within said channel means in a direction generally parallel to its length and (c) said vertical control means limiting vertical movement of said bayonet member to a predetermined distance necessary to permit rotation of said attachment means from storage position to hanging position without interference between said attachment means and other dispenser structure when said attachment means is not in hanging position.

12. The vertically adjustable hanger of claim 11, wherein said vertical control means of said bayonet member comprises an outwardly extending member which engages with said locking means of said channel means to prevent vertical adjustment of said bayonet member within said channel means when said hook means is oriented into storage position, and wherein said outwardly extending member is disengaged from said locking means to thereby permit vertical adjustment of said bayonet member within said channel whan said hook means is rotated to said hanging position.

13. The vertically adjustable hanger of claim 12, wherein said vertical adjustment means comprises a substantially resilient bulb member formed on the lower end of said bayonet member, said resilient bulb member frictionally interacting with the inner surfaces of said channel means to provide vertical adjustability of said hanger.

14. The vertically adjustable hanger of claim 13, wherein said outwardly extending member of said bayonet member is formed integrally with said resilient bulb member and wherein said channel means comprises an enlarged portion formed in the lower end of said channel means, with said enlarged portion including said locking means which engages said outwardly extending member when said hook means is oriented into storage position to prevent vertical adjustment of said bayonet member.

15. The vertically adjustable hanger of claim 14, wherein said resilient bulb member is a substantially hook-shaped resilient coil which is laterally compressible within said channel means when said attachment means is oriented into hanging position, and wherein said outwardly extending member comprises an upper locking element formed on said hook-shaped coil which cooperatively interacts with said enlarged portion of said channel means thereby resisting such lateral compression and preventing vertical adjustment of said bayonet member when said attachment means is oriented into storage position.

* * * * *